US006074676A

United States Patent [19]

Cadiente et al.

[11] Patent Number: 6,074,676

[45] **Date of Patent: *Jun. 13, 2000**

[54] BASKET FOR THE IMPROVED PACKING AND COOLING OF PRODUCE

[75] Inventors: Anthony Cadiente, Salinas; William Sambrailo, Aptos; Mark Sambrailo, Watsonville, all of Calif.

[73] Assignee: Plexiform Company, Watsonville, Calif.

[ * ] Notice: This patent is subject to a terminal disclaimer.

[21] Appl. No.: 09/060,453

[22] Filed: Apr. 14, 1998

Related U.S. Application Data

[63] Continuation-in-part of application No. 08/591,000, Jan. 24, 1996, Pat. No. 5,738,890.

[51] Int. Cl.[7] ..... B65D 21/032; B65D 85/34

[52] U.S. Cl. ..... 426/106; 206/501; 206/564; 229/120

[58] Field of Search ..... 426/106; 206/501, 206/564; 229/120

[56] References Cited

U.S. PATENT DOCUMENTS 2,652,335 9/1953 Conti ..... 426/106

2,660,529 11/1953 Bloom ..... 426/106

2,684,907 7/1954 Brunsing ..... 426/392

*Primary Examiner*—Leo B. Tentoni

*Attorney, Agent, or Firm*—Morton & Associates; Howard E. Morton

[57] ABSTRACT

Method for improved packing and cooling of produce by improving the flow of ventilation air to the produce, and apparatus to practice the method. According to the present invention, baskets for the packing of fruit are provided with ventilation channels disposed upon a lower surface of the basket. Vent apertures communicate between the ventilation channels and the produce stored in the baskets. After packing the baskets with produce, they are loaded into trays. The trays may be provided with tray vents which align with the ventilation channels. Alternatively, the trays may be formed without tray vents to improve some cooling regimes. In this manner, entire pallets of produce-filled baskets can be efficiently chilled by introducing a flow of cooling air into the baskets and thence through the produce packed inside. The trays and baskets are sized so as to occupy all of the surface area of a standard shipping pallet, and to minimize the movement of the baskets within the trays, and of the trays with respect to one another.

20 Claims, 17 Drawing Sheets

BASKET FOR THE IMPROVED PACKING AND COOLING OF PRODUCE

CROSS-REFERENCE TO RELATED PATENTS

This application is a continuation-in-part of application Ser. No. 08/591,000, filed Jan. 24, 1996, and issued on Apr. 14, 1998 as U.S. Pat. No. 5,738,890.

TECHNICAL FIELD

The present invention relates to an improved basket for the improved packing, cooling, storage, and shipping of produce. More particularly, the present invention is an improved container system comprising vacuum formed fruit containers received into and in operative combination with an improved tray design for optimizing the cooling and shipping of fruit, particularly of berries.

BACKGROUND ART

Many produce products are harvested and packed in the field into containers which are ultimately purchased by the end consumer. Examples of such produce items include, but are not limited to, tomatoes, berries, grapes, mushrooms, radishes and broccoli florets. Many of these produce items require substantial post-harvest cooling in order to enable shipping over long distances and to prolong shelf life.

In use, a grower's harvesting crew harvests produce items of the type previously discussed directly from the plant in the field into the container. The containers are then loaded into trays, which contain a specific number of individual containers and the trays, when filled, are loaded onto pallets. The most common pallet used in the produce industry is the forty by forty-eight inch (40"×48") wooden pallet, and the vast majority of produce handling, storage and shipping equipment is designed around pallets of this size.

After the pallets have been filled and loaded in the field, they are transported to shippers who perform a variety of post-harvest processes to enhance the marketability of the produce itself. For many types of produce, including berries, a significant packing evolution is the post-harvest cooling of the packed fruit. Indeed, berry shippers are often referred to as "coolers". The process of cooling berries typically includes injecting a stream of cooling air into one side of a tray and thence through the individual baskets and around the berries stored therein. As the air cools the berries, it picks up heat therefrom which is exhausted from apertures on the opposite side of the tray.

Packages for use by berry coolers have undergone a systematic process of evolution to improve the storing and cooling of the fruit while reducing packaging costs. While early berry packaging products included the use or folded wood or chipboard containers, a common package for the marketing of strawberries for instance, is a one pound vacuum formed plastic basket developed in conjunction with Michigan State University. This one piece package, hereinafter referred to for brevity as a "Michigan basket", includes a basket body formed with an integral hinged lid which, after the basket is filled with fruit, is folded over and locked in place with respect to the basket body. The lid is retained in position by means of a detent, which engages an edge flange of the basket body. Disposed at or near the substantially flat bottom of the basket body are a plurality of apertures, typically elongate slots, to provide air flow through the body of the packed fruit in the basket. This air flow continues through a similar series of apertures formed in the lid. In the case of the strawberry package, typically, eight (8) sixteen ounce (16 oz) baskets are loaded into a formed and folded corrugated cardboard tray.

The tray developed for use with the Michigan basket has one or more openings along either of its short ends to enable air flow through the tray. From the previous discussion on berry cooling, it will be appreciated that in the typically formed strawberry package system in current use, the two individual baskets within the tray which are immediately adjacent to the air intake apertures formed in the ends of the tray receive substantially more cooling from air inflow than do the two packages at the discharge end of the tray. To overcome this deficiency in air flow, berry coolers are currently required to utilize substantial amounts of cooling energy to ensure that fruit packed at the discharge side of the tray receives sufficient cooling to prolong its shelf life, while precluding the freezing of berries at the intake side of the tray.

The previously discussed problem is due to the fact that the one pound strawberry baskets and the tray which contains it were developed separately. Specifically, the design of the previously discussed one pound strawberry basket was finalized prior to the design of the tray which ultimately receives eight of these baskets therein. The previously discussed one pound strawberry containers in current use measure approximately four and three quarter inches by seven and one quarter inches (4¾"×7¼") and are three and one half inches (3½") tall with the top secured. As a result, the commonly used eight basket tray measures approximately fifteen and one-half inches by nineteen and three quarters inches (15½"×19¾"). This tray size is to some extent mandated by the size of the baskets it contains. While no great difficulty was likely encountered in forming a tray to fit a given number of the baskets, the area or "footprint" of the resultant tray was not given sufficient consideration in the design of the baskets. This has given rise to a significant inefficiency of packaging.

Because the current eight - one pound strawberry trays, and the baskets shipped therein are not fitted together properly, the package does not fully utilize the surface area of a forty by forty eight inch pallet, therefore shipping of those pallets is not optimized. Specifically, using current basket technology, a layer of strawberries comprises six (6) trays per layer on the pallet. With eight (8) one pound baskets per tray, this means that forty eight pounds of fruit can be packed per layer on a standard 40 inch by 48 inch pallet. Because there is no way with current use packages to completely fill the pallet with trays, a significant portion of the pallet remains unused. This of course forms a further inefficiency of shipping.

Another problem with current use plastic produce baskets is that they are usually formed with vertical stiffening ribs. This is done to maximize the resistance of the relatively thin basket to deformation. These ribs also provide salient intrusions into the body of the basket. Where a pulpy fruit, such as berries, are packed in the basket, handling shock to the packed fruit, combined with its own weight turns these intrusions into sites where significant bruising of the packed fruit occurs. This loss of fruit quality results in higher costs the shipper, transporter, retailer and consumer alike.

The previous discussion has centered on the specific case of the one pound whole strawberry container preferred by consumers. It should be noted, however, that while strawberries comprise the bulk of all U.S. berry consumption, other berry crops also enjoy a significant position in the marketplace. Each of these berry crops has, to a certain extent, given rise to preferred packaging embodiments therefor. By way of illustration but not limitation, while strawberries are typically sold in eight ounce or one pound containers, blueberries are typically sold by volume, specifically, consumers tend to prefer the one pint package of blueberries. Raspberries, on the other hand, are typically marketed in small five or six ounce trays.

The trays into which each of these differing types of berry baskets are ultimately installed have not been designed with a view to integrating them with other berry or indeed other produce crops. This presents a problem to the small-to-medium sized grocery establishment which may not order berries in multiple pallet lots but may prefer, for various reasons, to mix quantities of berries on one pallet. Because the trays used in the several aspects of the berry industry are not integrated one with another this capability is, at present, not realized. Accordingly, smaller lots of berries as commonly shipped to small-to-medium sized grocers must typically be sold at a premium cost in order to compensate the grower, shipper and transporter for the packing and shipping inefficiencies occasioned by the lack of packaging design cohesion.

Another problem with the previously discussed Michigan basket is the latch which retains the lid in the closed position with respect to the body. The Michigan basket uses a single detent formed in the lip of the lid to engage the edge of the basket body lip. This latch arrangement has proven troublesome in that it is difficult to quickly and securely close in the field while being prone to unwanted opening during packing, shipping and while on the grocer's shelves.

Other workers in the packaging arts have attempted to solve the previously discussed latch deficiencies by means of forming snap fasteners in the edge material of the plastic baskets which they produce. The results obtained by this design are mixed. While the snap fasteners may be slightly more secure than the previously discussed edge latch, they are at least as difficult to align properly by pickers in the field as the Michigan basket latch.

The trays currently available for use with Michigan baskets designed for one pound strawberry packing are not generally well suited for the baskets in that the baskets are allowed considerable freedom of movement within the trays. This results in an increased incidence of shifting of the baskets within the trays, which causes an increase in bruising of the fruit stored in the baskets.

The final problem not contemplated by the prior art is that different quantities, types, and external forms of produce a require different cooling air flow regimes. Some combinations of fruit types and quantities benefit from the relatively laminar flow provided by the invention of U.S. patent application Ser. No. 08/591,000. Further research has shown that some combinations of produce quantity and type benefit from a relatively turbulent air flow through the basket during the cooling process.

What is clearly needed is an improved berry packing system which will significantly reduce the cooling time and cooling expense for the fruit contained in the baskets. To make such an improved system feasible, it must interface with commonly used and preferred materials handling apparatus, specifically the previously discussed forty by forty eight inch pallets in current use in the grocery industry.

The baskets of such a system should be capable of being formed in the preferred size or quantity configuration preferred by the end consumer, while simultaneously maximizing their footprint on existing pallet technology. The baskets should be formed to minimize bruising and other damage to the fruit packed therein. Furthermore, such a system should provide for the mixing of lots of different types, quantities and sizes of produce on a single pallet without substantial losses of packaging efficiency occasioned by differing types of misaligned trays.

The basket should possess a lid latch capable of being quickly and securely fastened in the field. The same lid should be capable of being repeatedly opened and closed during packing, while on the grocer's shelves and ultimately by the end consumer.

The packaging system should enable the packaging of one layer, or a plurality of layers of filled baskets therein.

Finally, the several components of the packaging system should be capable of providing cooling air flow regimes relatively optimal for the type and quantity of produce to be stored in the baskets.

If possible, the system should be formed utilizing existing equipment and machinery from materials of the same or lesser cost than currently available fruit packages.

DISCLOSURE OF INVENTION

The present invention, available as the Mixim packaging from Sambrailo Packaging of Watsonville, Calif., comprises an improved berry packing system which matches trays with baskets to significantly reduce cooling time and expense for the fruit contained in the baskets. This is done by several means. First, cooling channels are formed in base of the individual baskets. These channels may be aligned with apertures formed in the sides of the trays into which the baskets are loaded. Second, the lid, when closed over the basket body defines at least one, and preferably a plurality of horizontal slots. These slots, in combination with other apertures formed in both the basket body and lid significantly improve air flow through the basket. The size, number and extent of the horizontal slots and their respective vertical positions on the basket may be arranged to optimize cooling for the type and quantity of produce for which the basket is formed. Thus, the combination of basket horizontal slots, apertures and the cooling channels aligned with tray apertures provides a significantly improved flow of cooling air flow through the berries. This improved air flow results in improved cooling efficiency and hence lower packing cost, resulting in a better quality berry, having a longer shelf life, and delivered to the consumer at a lower cost.

The cooling air flow provided by the several embodiments of the present invention may be optimized for generally laminar cooling air flow, relatively turbulent air flow, or some combination thereof. This is accomplished by selecting cooling slot geometries and tray configurations which provide the desired air flow regime.

The packing system of the present invention interfaces with commonly used and preferred materials handling apparatus, specifically the forty by forty-eight inch pallets in standard use in the grocery industry. The trays of the present invention are designed to completely fill such a standard pallet. This results in significant improvements in shipping efficiencies, again lowering costs to the consumer.

The baskets of such a system are capable of being formed in the preferred size or quantity configuration preferred by the end consumer, while simultaneously maximizing their footprint on standard pallets. Thus, the system provides for the mixing of lots of different types, quantities and sizes of produce on a single pallet without any of the substantial losses of packaging efficiency occasioned by packing differing types of misaligned trays. This advantage is accomplished by utilizing trays of the same area, but which may differ in their vertical dimension. The different trays required for different fruits, as taught by the present invention, not only possess the same footprint, but the same lug configuration as well. Accordingly, the present invention provides for the intermixing of different capacity trays on the same pallet. The only requirement is that trays in a given layer should all possess similar heights.

The baskets taught herein are formed to minimize bruising and other damage to the fruit. This is accomplished by designing the baskets without vertical stiffening ribs or other salient intrusions into the basket, but with gentle curves on substantially all those surfaces which come into contact with the fruit packed within. This further minimizes costs and losses to the grower, shipper, transporter and retailer. The baskets possess a lid latch capable of being quickly and securely fastened in the field. The same lid is capable of being repeatedly opened and closed during packing, while on the grocer's shelves and ultimately by the end consumer. The system is capable of being formed utilizing existing equipment and machinery, and generally from materials of the same or lesser cost than currently available fruit packages.

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Present Invention. In the drawing.

Figure 1:
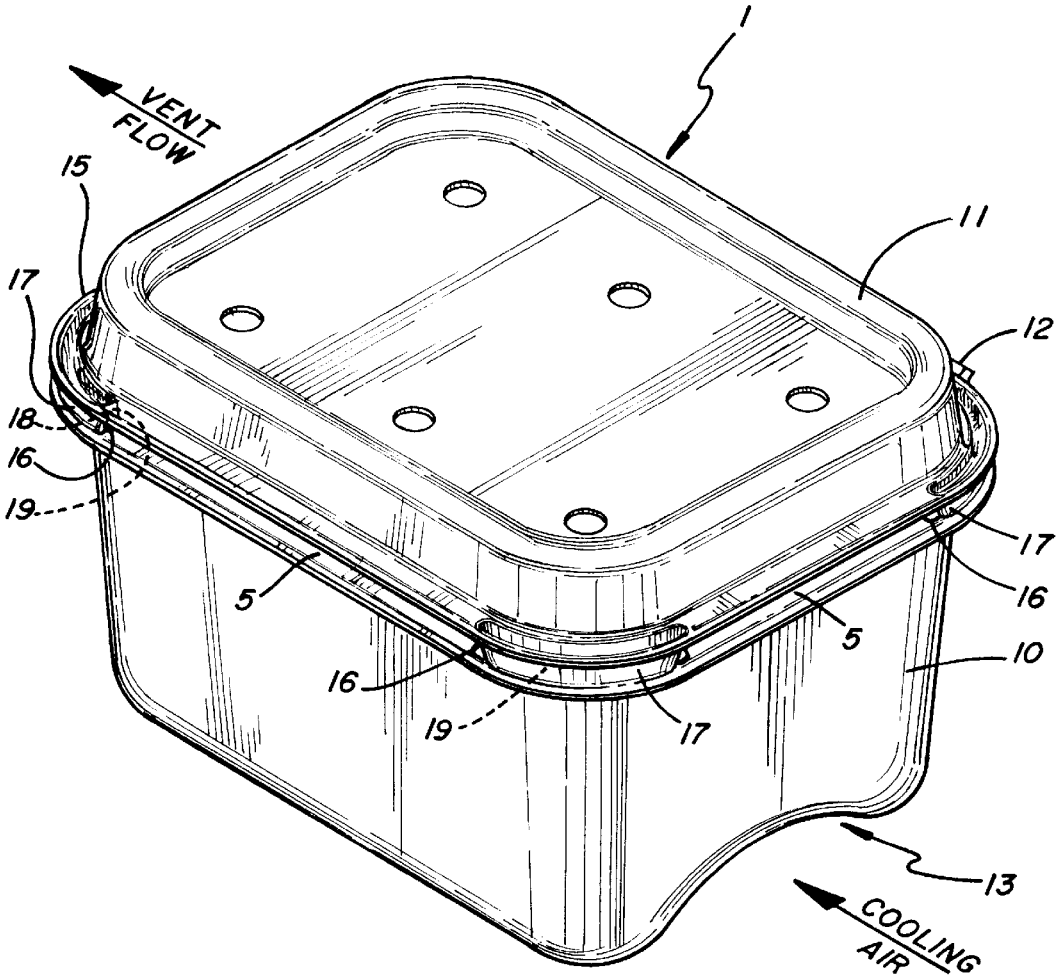
FIG. 1 is a perspective view of a closed produce basket according to the principles of the present invention.

Reference numbers refer to the same or equivalent parts of the present invention throughout the several figures of the drawing.

BEST MODE FOR CARRYING OUT THE INVENTION

Having reference to FIG. 1, a first preferred embodiment of the produce basket 1 of the present invention is shown. Produce basket 1 is a one-piece structure incorporating both basket body 10 and lid 11. That portion of produce basket 1 joining basket body 10 and lid 11 is formed as a hinge, 12. Basket body 10 is further defines a transverse concavity defining channel 13. While a first preferred embodiment is a vacuum formed plastic structure, the principles of the present invention are equally applicable to alternative materials and manufacturing technologies. In a first preferred embodiment of the present invention, the basket is formed of Kodapak® PET Copolyester 9921, available from Eastman Kodak. Alternative materials include, but are not limited to various polymeric and monomeric plastics including but not limited to styrenes, polyethylenes including HDPE and LPDE, polyesters and polyurethanes; metals and foils thereof; paper products including chipboard, pressboard, and flakeboard; wood and combinations of the foregoing. Alternative manufacturing technologies include, but are again not limited to thermocasting; casting, including die-casting; thermosetting; extrusion; sintering; lamination; the use of built-up structures and other processes well known to those of ordinary skill in the art.

Figure 7:
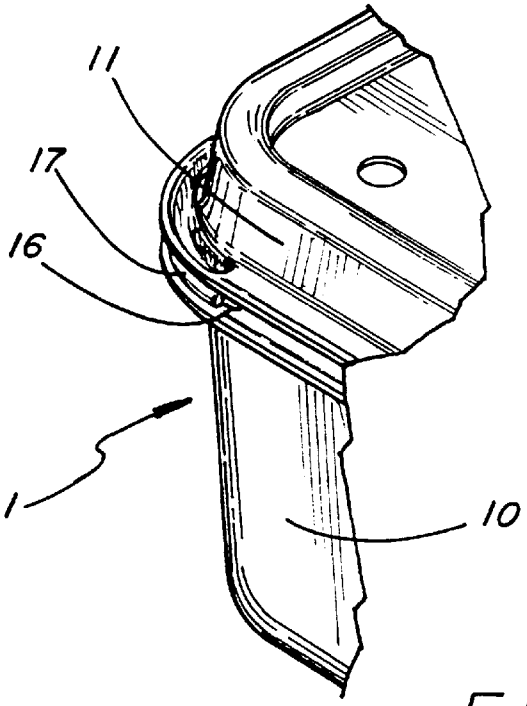
FIG. 7 is a detail of the lid detent of the produce basket after closing the lid over the basket body.
Figure 6:
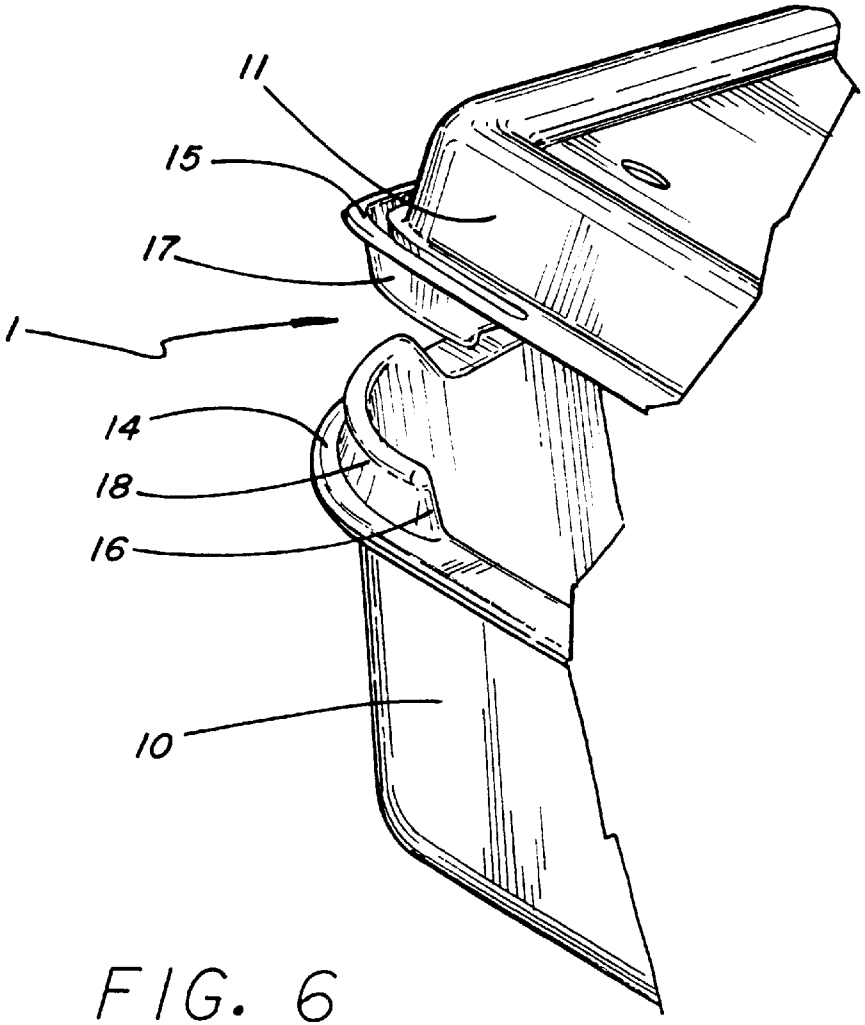
FIG. 6 is a detail of the lid detent of the produce basket posed prior to closing the lid over the basket body.

Continuing with this first preferred embodiment, and referring now to FIGS. 6 and 7, each of basket body 10 and lid 11 has formed about the periphery thereof a lip, 14 and 15 respectively. In a first preferred embodiment shown in FIG. 1, lid 11 is held in the closed position by at least one set of paired, mating detent latches 16 and 17. Latches 16 and 17 are formed as substantially vertically protruding members from lips 14 and 15 respectively. Latches 16 and 17 include teeth 18 and 19. When lid 11 is closed over body 10, tooth 18 of latch 16 engages tooth 19 of latch 17, and maintains lid 11 secured in the closed position with respect to body 10. Teeth 18 and 19 are maintained in the latched condition by the elastic deformation of latches 16 and 17. In a first preferred embodiment, a pair of latches 16 and 17 are disposed about each of the front corners of basket 1. A third pair of latches 16 and 17 is disposed about the rear edge of basket 1. In this manner, lid 11 is secured to body 10 by three pairs of latches, acting in compressive opposition. This arrangement provides a lid closure which is at once more easily effected under field conditions, more secure and may be more easily opened and resealed than previous fruit basket latches.

Figure 2:
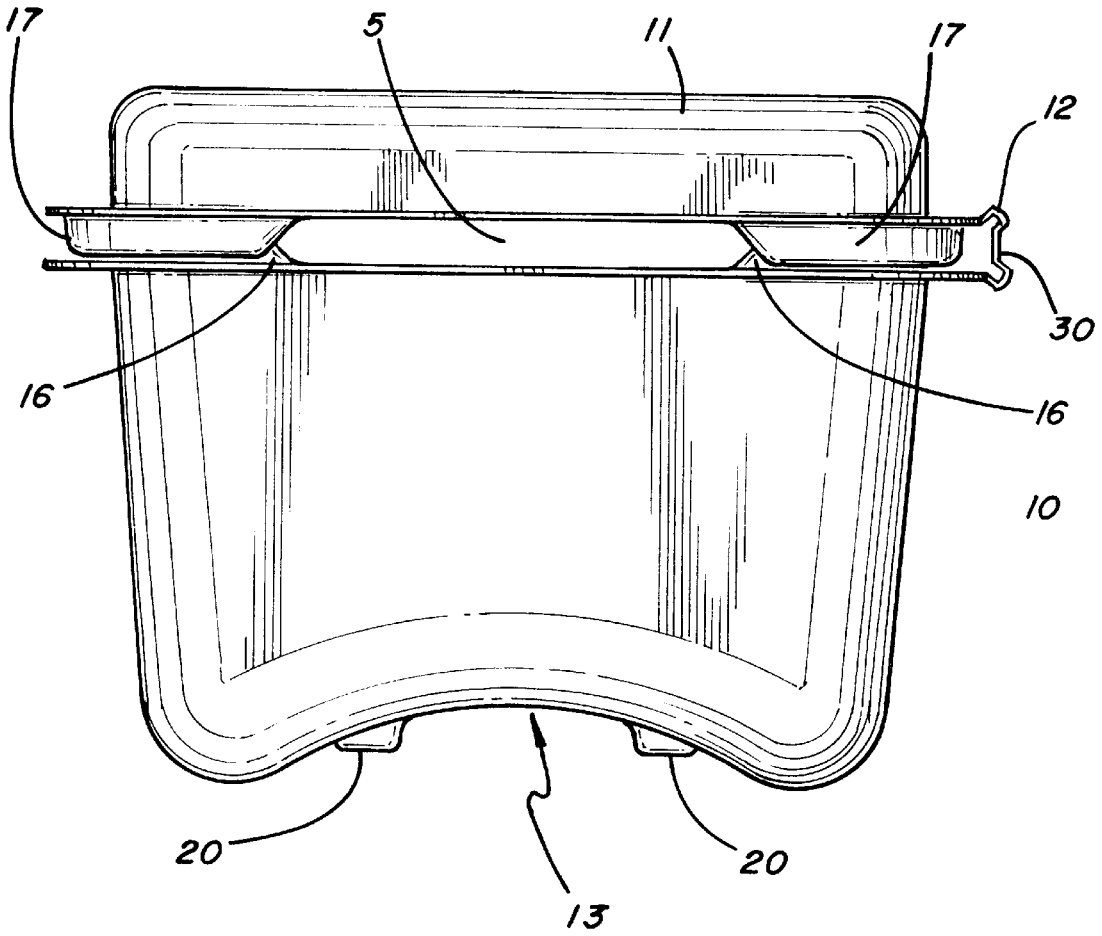
FIG. 2 is an end view of this closed produce basket.

Having reference to FIG. 2, some of the improved ventilation features of this first preferred embodiment of the present invention are shown. Lateral ventilation channel 13 is formed at a substantially lower portion of body 10. Channel 13 is disposed on body 10 to provide an improved flow of cooling air and ventilation through the lower portion of body 10. To accomplish this, at least one, and preferably a plurality of vent apertures (not shown) are defined within vent bosses 20. In order to provide a similarly improved flow of cooling air and ventilation through the upper portion of body 10, vent slot 5 is defined when lid 11 and body 10 are secured together. Slot 5 is maintained at a fixed distance by paired detent latches 16 and 17. The flow of cooling air through the basket is further improved by at least one, and again preferably a plurality of vent apertures (not shown) in the upper surface of lid 11.

Figure 3:
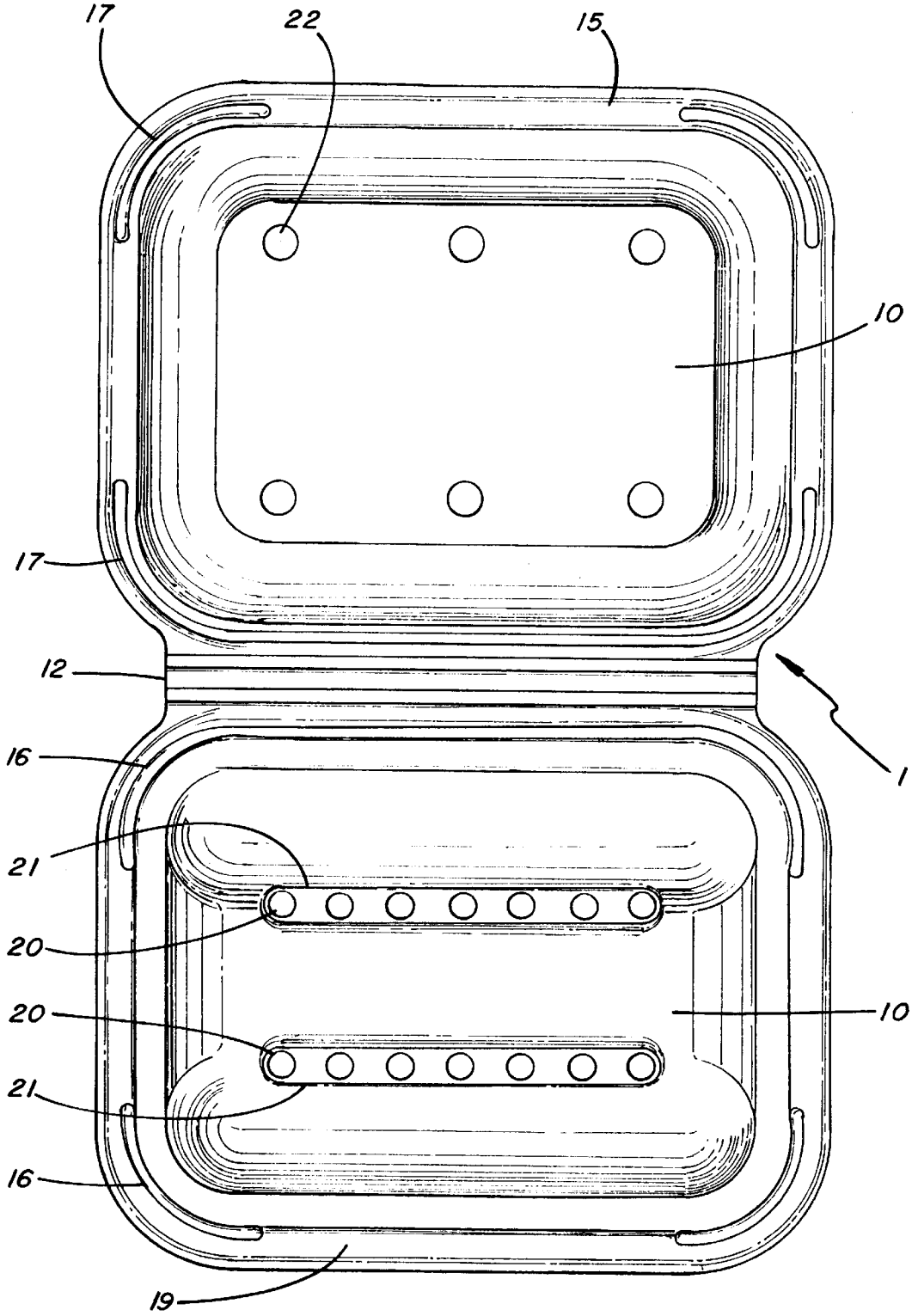
FIG. 3 is plan view of an open produce basket according to the principles of the present invention.

The upper and lower vent apertures, 22 and 21 are clearly shown in FIG. 3. Also shown in this figure are the general arrangement of detent latches 16 and 17. In a first preferred embodiment, lower latches 16 are disposed about a substantially inner portion of lower lip 14, while upper latches 17 are disposed about a substantially outer portion of upper lip 15. In this manner, when lid 11 is secured to body 10, lower latches 16 are substantially captured within upper latches 17, and maintained in an engages configuration by the elastic deformation of latches 16 and 17 in operative combination with teeth 18 and 19 (not shown). Furthermore, lateral movement and potential disengagement of lid 11 from body 10 is substantially precluded by latches 16 and 17 disposed about the portions of body 10 and lid 11 immediately adjacent to hinge 12. This pair of latches, in a preferred embodiment, is disposed upon the entire width of body 10 and lid 11 respectively.

With continued reference to FIG. 3., it will be apparent that in closing lid 11 onto body 10, latches 16 and 17 disposed about the portions of body 10 and lid 11 immediately adjacent to hinge 12 will be the first to engage as lid 11 is closed. After teeth 18 and 19 (not shown) of this latch pair engage, the act of closing lid 11 continues, and latches 16 and 17 at the front end of basket 1 are engaged. The operator, by applying further closing pressure, elastically deforms to some degree at least some of latches 16 and 17, engaging teeth 18 and 19 (not shown) and thereby securing lid 11 onto body 10.

While the preceding discussion regarding a first preferred embodiment has centered on a one piece basket incorporating the basket body and lid joined by a hinge, it will be immediately apparent to those of ordinary skill in the art that the principles of the present invention may with equal facility be embodied in a two piece implementation utilizing a separate body and lid. This embodiment is specifically contemplated by the teachings of the present invention.

The preceding discussion details a first cooling regime wherein cooling air is actively urged towards both channel 13 and vent slot 5. It is thought that this cooling regime may result in a more laminar flow of cooling air about produce contained within basket 1. For some combinations of produce type and quantity however, a different cooling regime results in superior cooling. To produce this cooling regime, cooling air is actively urged only towards vent slot 13. It is thought that this results in a more turbulent flow of cooling air about the enclosed produce, and that cooled air exits both through vent channel 13 and the opposite end of vent slot 5. This alternative cooling regime is provided by use of alternative tray designs, as described below, and may be accentuated by certain modifications to the basket design itself.

Figure 9:
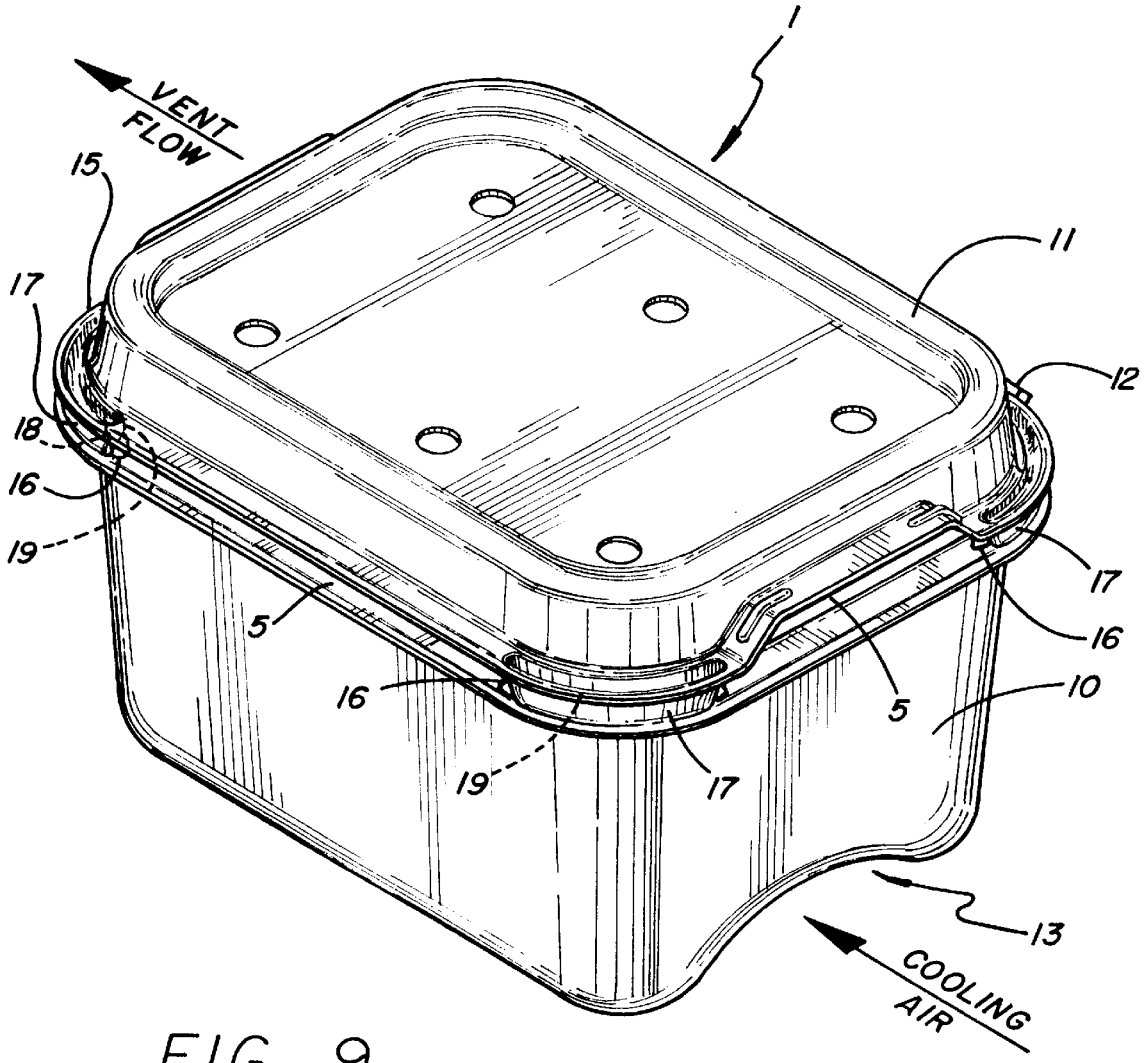
FIG. 9 is a perspective view of a closed first alternative produce basket formed according to the principles of the present invention.
Figure 10:
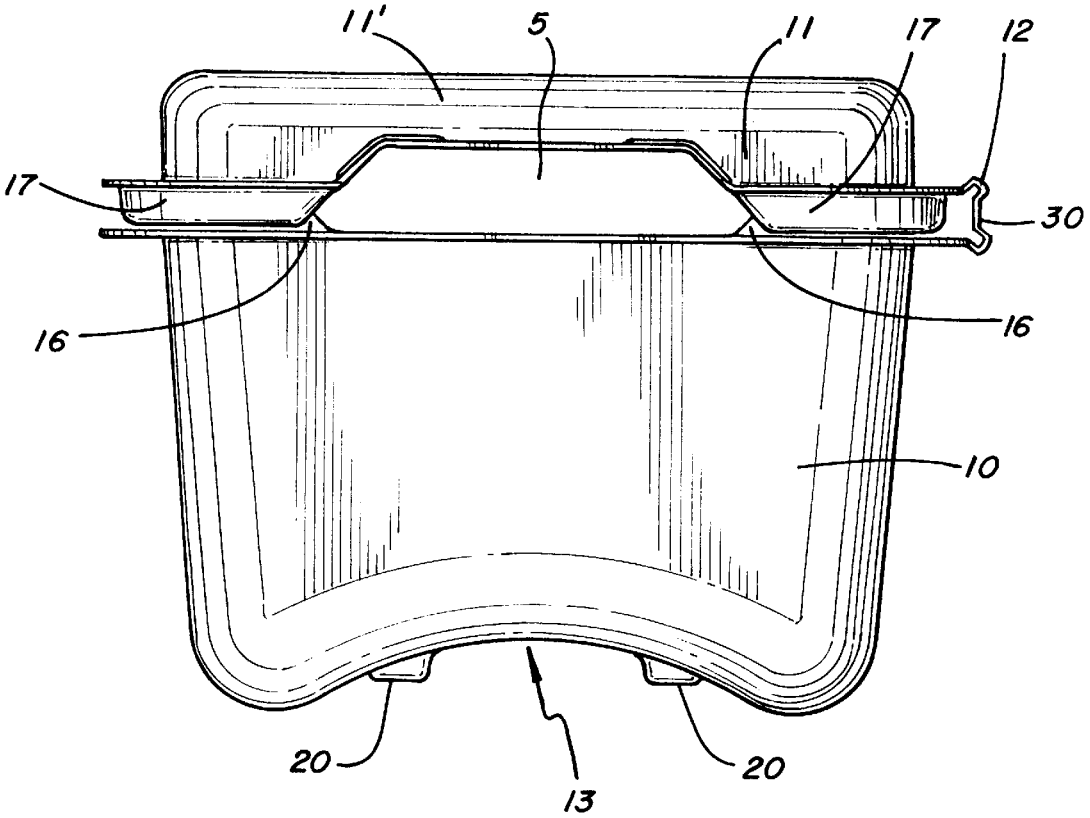
FIG. 10 is an end view of the closed first alternative produce basket.

Continued research into produce cooling has shown that some produce type/quantity combinations require different velocities of cooling air to achieve optimal cooling. This can be attained by altering the size of slot 5 in the following manner: in the second preferred embodiment of the present invention shown in FIGS. 9 and 10, the vertical extent of slot 5 is substantially increased upwardly from the embodiment shown in FIGS. 1 and 2. This is accomplished by extending the cut out portion 11' in a substantially upward direction. This extension will often exceed one half of the lid portion of basket 1.

Figure 4:
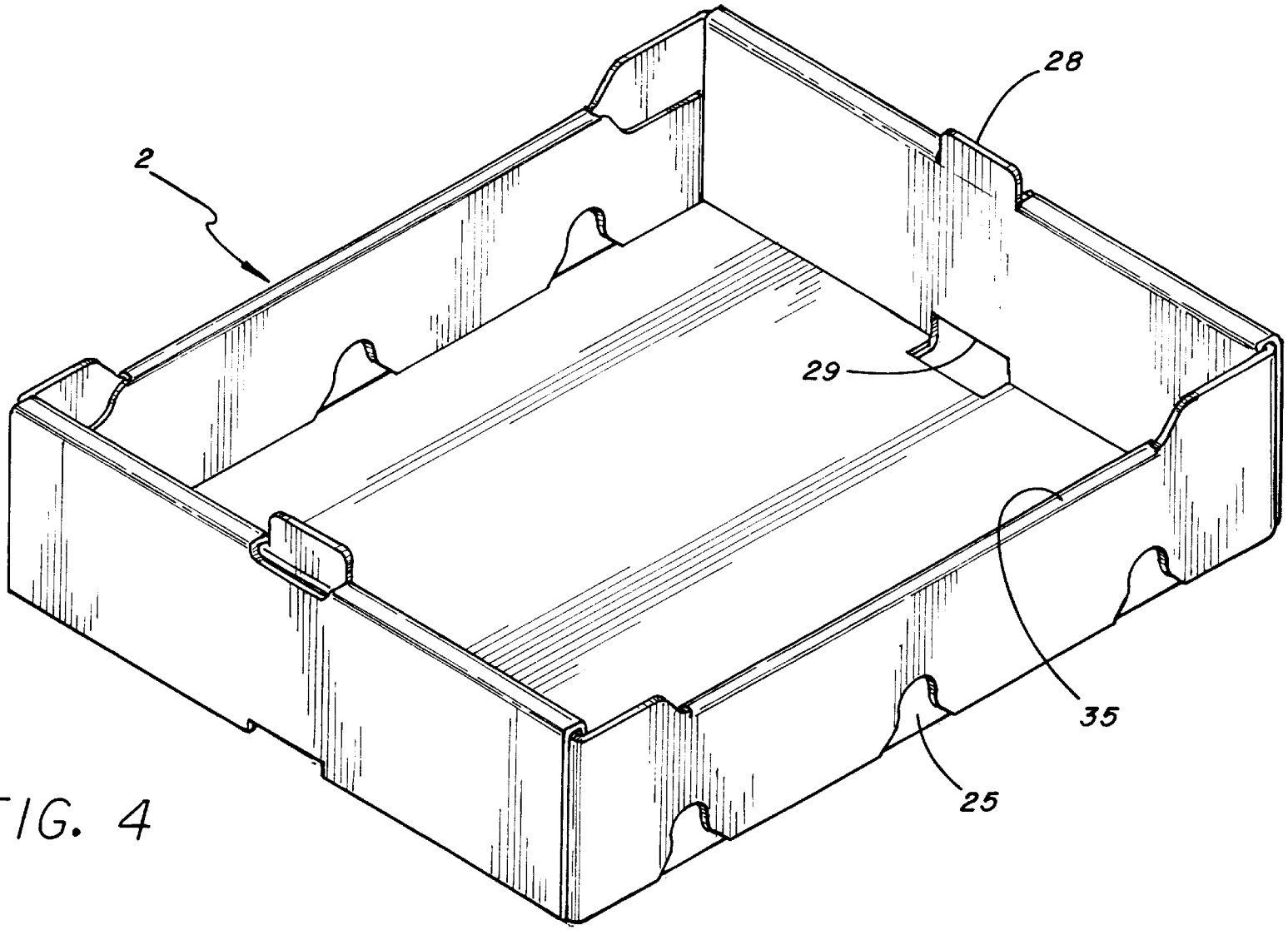
FIG. 4 is a perspective view of a tray as taught by the present invention.
Figure 5:
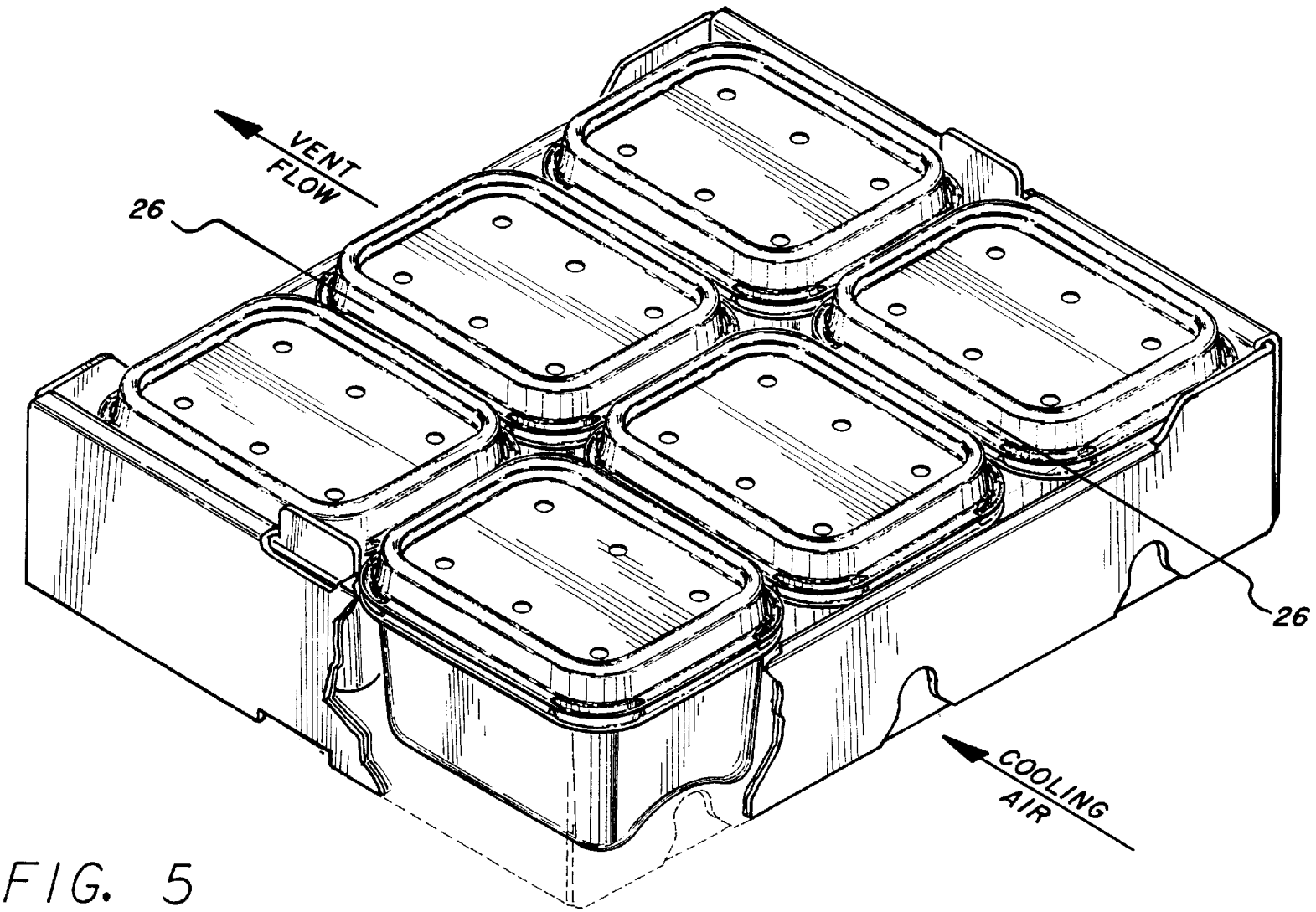
FIG. 5 is a perspective view of a plurality of closed produce baskets loaded into trays as taught by the present invention.

Having reference now to FIGS. 4 and 5 a first preferred tray, 2, formed according to the principles of the present invention is shown. Tray 2 is sized to hold at least one and preferably a plurality of baskets (not shown in this figure). In one preferred embodiment of the present invention, tray 2 holds six baskets 1. A particular feature of tray 2 is the plurality of tray vents 25. As shown in FIG. 5, tray vents 25 align with the previously discussed vent channels formed in the bottom of baskets 1. In this manner, a direct path is created from the ambient atmosphere to the bottom surface of each basket 1 loaded into tray 2. Trays 2 are formed such that when stacked a lateral vent slot 26 is formed between each pair of trays 2. Air vented from baskets 1 is vented from tray 2 at vent slots 27. This means of tray ventilation, together with the previously described improvements in basket ventilation combine to ensure that all berries in the tray receive significantly greater cooling ventilation than any previous fruit cooling and packaging system, thereby creating significant reductions in cooling energy requirements. Indeed, preliminary testing indicates that the improved cooling afforded by the ventilation arrangement of the present invention may cut cooling costs for some strawberry packing operations by as much as 25%.

With continued reference to FIG. 4, tray 2 is further formed with at least one cutaway section, 35, which aligns with the horizontal ventilation slot of basket 1, when loaded into tray 2. This provides for improved flow of cooling air towards the top of basket 1 when loaded in tray 2.

Figure 11:
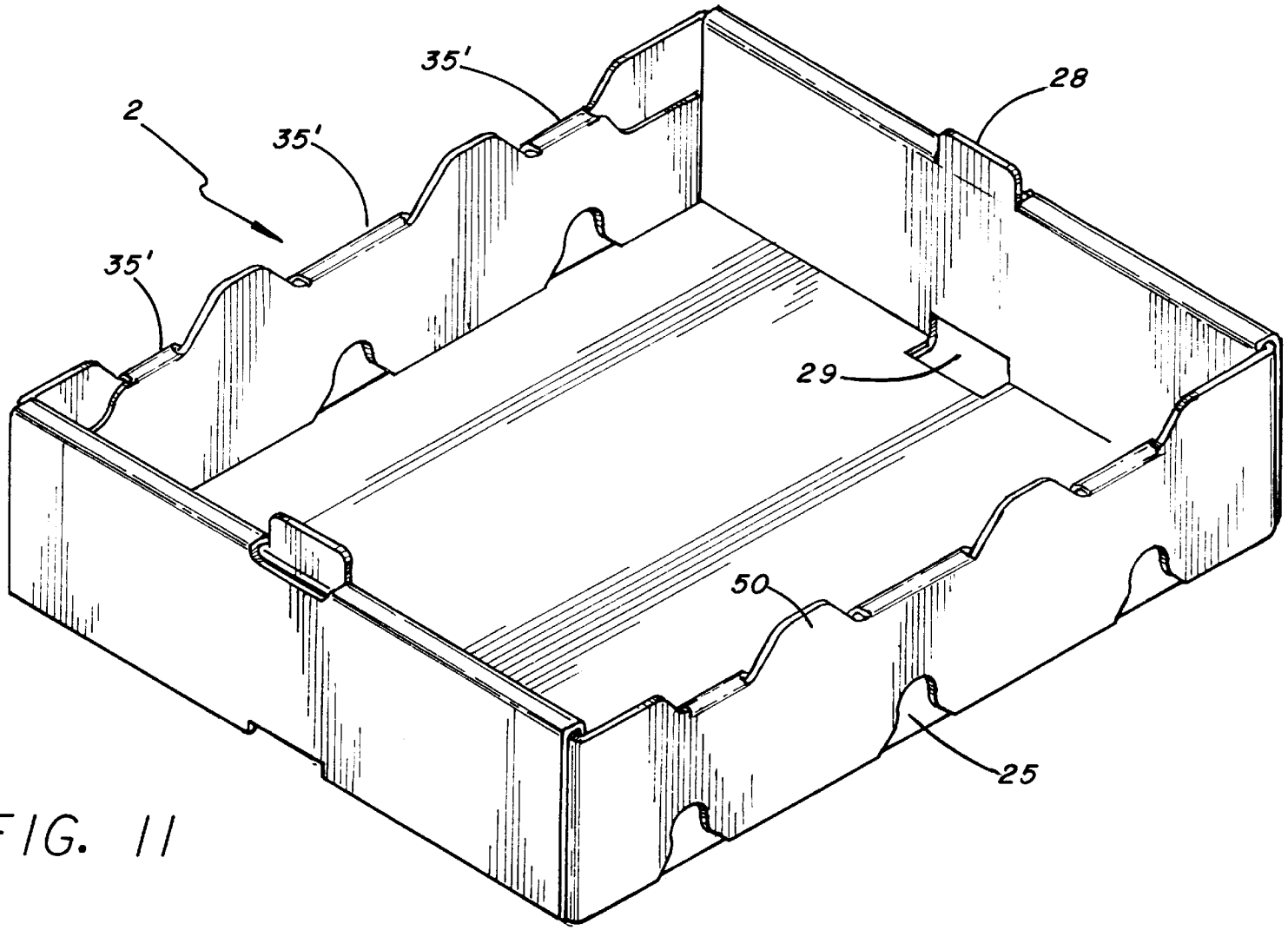
FIG. 11 is a perspective view of a first alternative tray incorporating flow restriction tabs.
Figure 12:
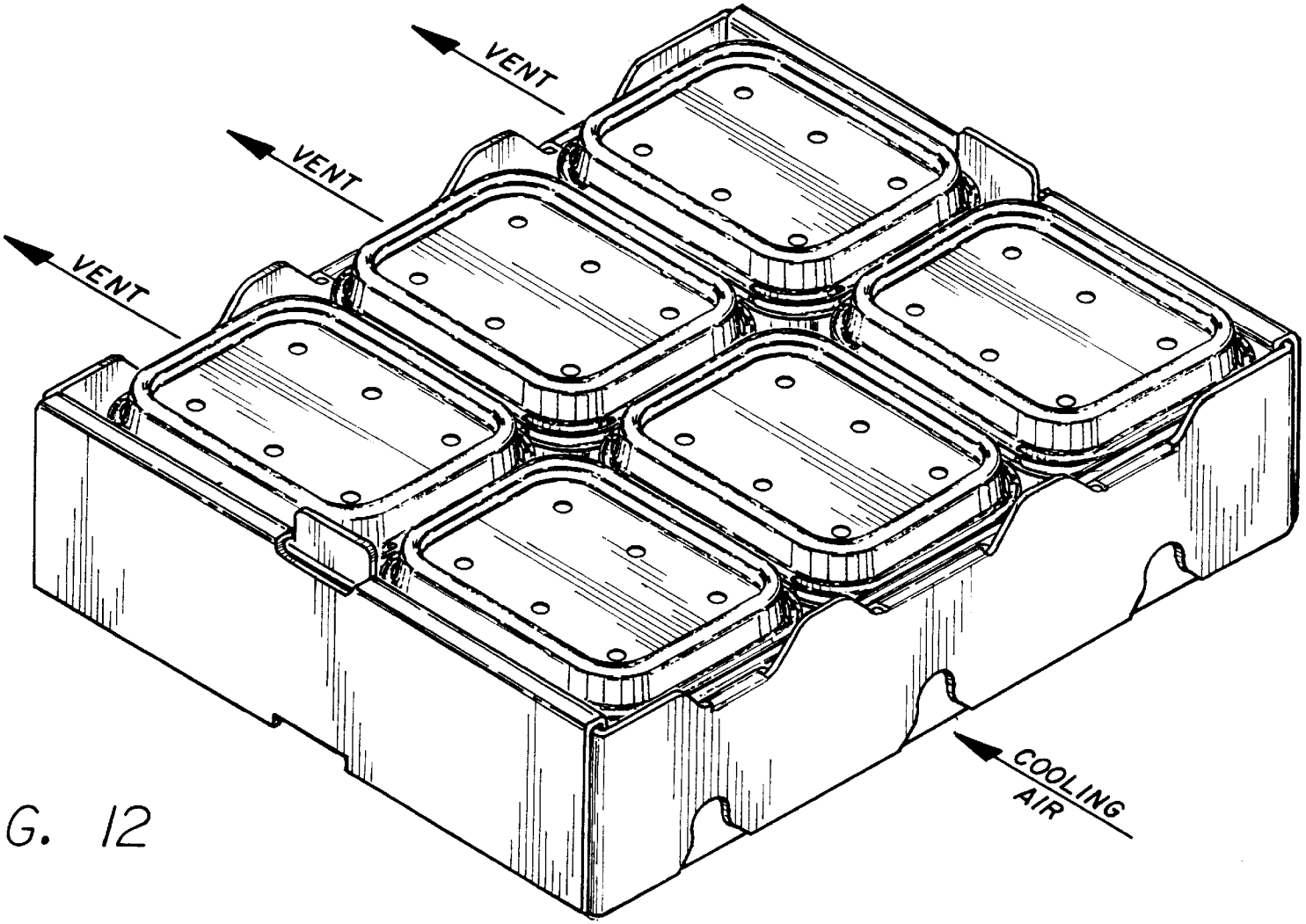
FIG. 12 is a perspective view of a plurality of closed produce baskets loaded into the first alternative tray.

Having reference now to FIGS. 11 and 12, cutaway section 35 may be formed into a further plurality of sections 35', separated by divider tabs 50. Sections 35' serve to direct the flow of cooling air only into horizontal slot 5 of basket 1 (not shown). In this manner, cooling efficiency is improved. The flow of cooling and vent air provided by this embodiment is shown in FIG. 12.

With continued reference to FIG. 4, trays 2 are formed to minimize lateral movement of one tray with respect to another by means of at least one tab 28 formed at an upper edge of tray 2 in operative combination with at least one receptacle 29 similarly formed on a substantially lower edge of the corresponding side. In this manner, when a plurality of trays 2 are loaded, for instance onto a pallet, tab 28 of a lower tray is received into receptacle 29 of the tray loaded onto it. Tab 28 may be formed to accept therein stacking wires (not shown), in accordance with generally accepted container design practice. These stacking wires generally take the form of an elongated U-shaped member which are inserted through tab 28 of one tray and thence through corresponding tabs 28 of one or more trays stacked thereon. Stacking wires thus utilized not only reduce lateral movement of one tray with respect to another, but can also form a handle for the facile handling of a plurality of trays at one time.

Figure 8:
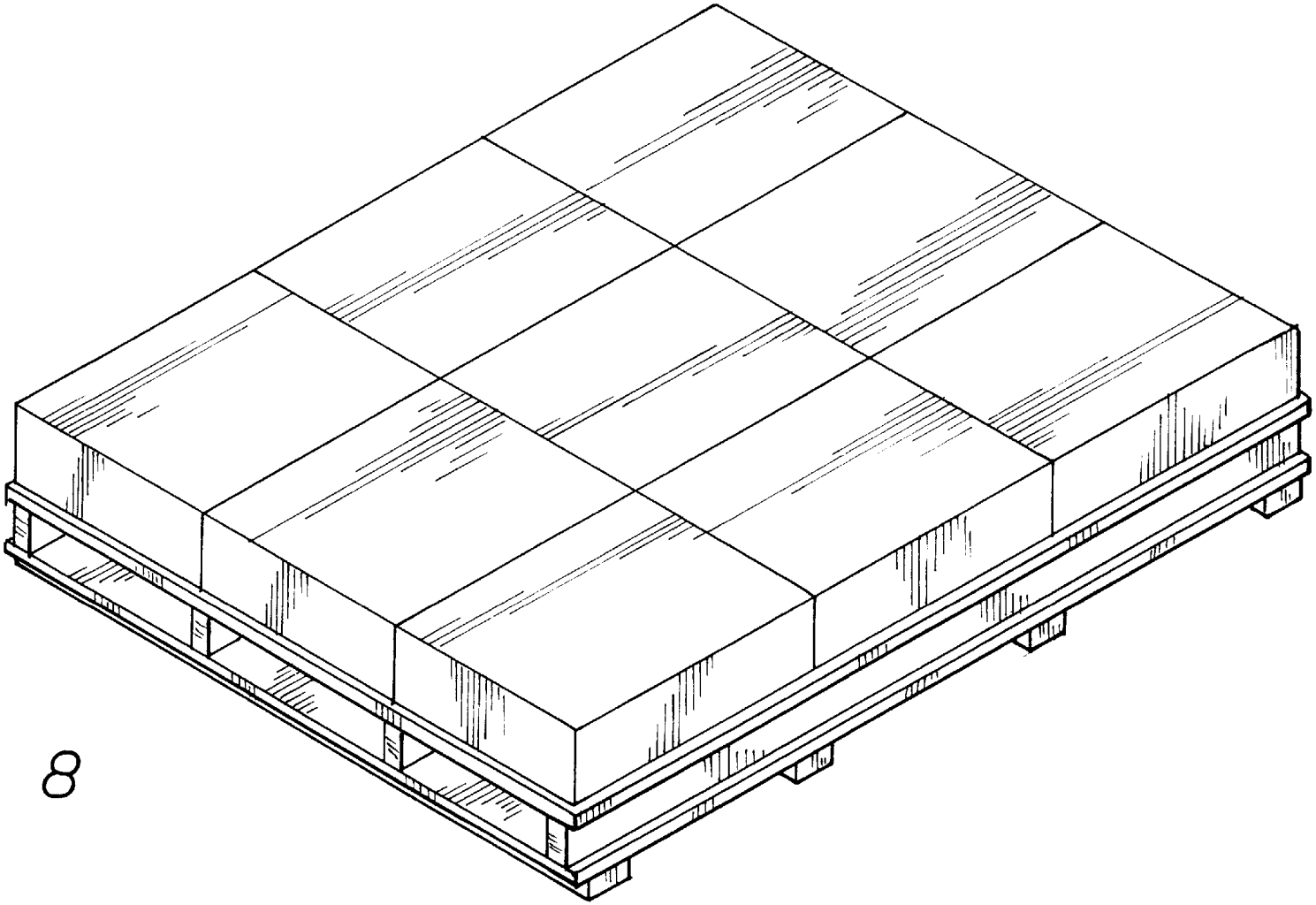
FIG. 8 is a perspective view of a plurality of trays of the present invention shown loaded on a pallet.

Having reference now to FIG. 8, a significant savings in shipping costs is realized by sizing baskets 1 and trays 2 as a system to maximize the area or shipping footprint of a layer of trays on a pallet. As previously discussed, the 40 inch by 48 inch pallet is the preferred standard size in the grocery business. Current Michigan baskets measure approximately 4¾" by 7¼" by 3½" tall when closed and are loaded eight per tray. This tray measures approximately 19¾" inches by 15¾" inches. A maximum of six such trays constitute a layer on a 40 inch by 48 inch pallet. Where the trays are loaded with one pound strawberry baskets, a maximum of 48 pounds of fruit may thus be loaded in each layer. In contrast, baskets of the present invention designed to receive therein one pound of strawberries are sized approximately 6⅜"×5"×3¾" high, when closed. Tray 2 of the present invention is sized at approximately 16"×13¼". This size maximizes the footprint on a standard pallet. This means that nine such trays can be loaded as a layer on the previously described pallet, for a total of 54 pounds of fruit per layer. This represents an increase of 6 pounds, or 16 percent per layer over the Michigan basket. Since the shipper is not paying for wasted shipping volume his shipping costs are reduced, which can result in further savings to the consumer.

The vertical mating surface of the Michigan trays, that portion of the baskets which abut one another when loaded into trays, comprises little more than the mated edges of two thin sheets of plastic. Accordingly, because those mating surfaces protrude, and due to the thin nature of their vertical aspect, the mating surfaces of the Michigan basket are very much prone to over-riding one another. This allows the baskets to shift markedly inside the tray, which is a significant factor in the bruising of fruit stored in the baskets. Referring again to FIG. 2, it will be appreciated that to overcome this limitation, the baskets of the present invention further comprise an edge mating surface 30 formed by hinge 12 and latches 17. This edge mating surface is relatively broad in comparison to the Michigan baskets described herein. The combination of this relatively broad mating surface with a properly sized basket/tray combination has been shown to be especially effective in the reduction of damage to fruit stored therein.

The preceding discussion of a first preferred embodiment of the present invention has focused on one specific berry package design. It will be immediately obvious to those of ordinary skill in the art that the principles set forth herein are also applicable to a wide range of produce package sizes and utilizations. By way of illustration but not limitation, the present invention specifically contemplates the forming of 1 pint and ½ pint (also referred to 8 oz. or 250 g.) berry baskets, as well as baskets configured to receive therein specific produce shapes, types and counts. An example of the latter is the "long stem pack" used in the berry industry for shipping specific package counts of large, premium berries. Furthermore, while the discussion of the principles set forth herein has centered on packages for the berry industry, it is recognized that these principles may be applied with equal facility to the packaging of a broad range of materials including other foodstuffs or any item which would benefit from the advantages set forth herein. Such applications are specifically contemplated. These principles include the use of a family of trays, having fixed "footprints" or lengths and widths, but with whose heights are varied to accommodate baskets having different heights and/or counts per tray. By maintaining the footprint at a constant value, the advantages of minimizing lateral movement between individual trays and between layers of trays are attained because the trays of one layer interlock with the layer of trays above or below it. This is true even where adjacent tray layers contain significantly differing sizes of baskets, holding the same or different produce items.

Where the tray is designed to receive one pound strawberry baskets as previously discussed, the height of the tray is approximately 3-¾ inches. Where other berries, or indeed other produce products are shipped, the length and width of the tray do not change, but remain at the previously defined optimal size. Changes in tray volume necessary to accommodate differing numbers and volumes of baskets are accommodated by altering the height of the tray. In similar fashion, baskets designed for use in the present system are sized to fit within the previously discussed tray. In this manner, baskets suitable for substantially any size basket designed for consumer use, as well as many baskets sized for the food service industry, may be accommodated by the present invention. This presents the previously described advantage of enabling the shipment of a mixed pallet of differing produce by loading trays optimized for each type of produce onto separate, compatible layers.

Figure 15:
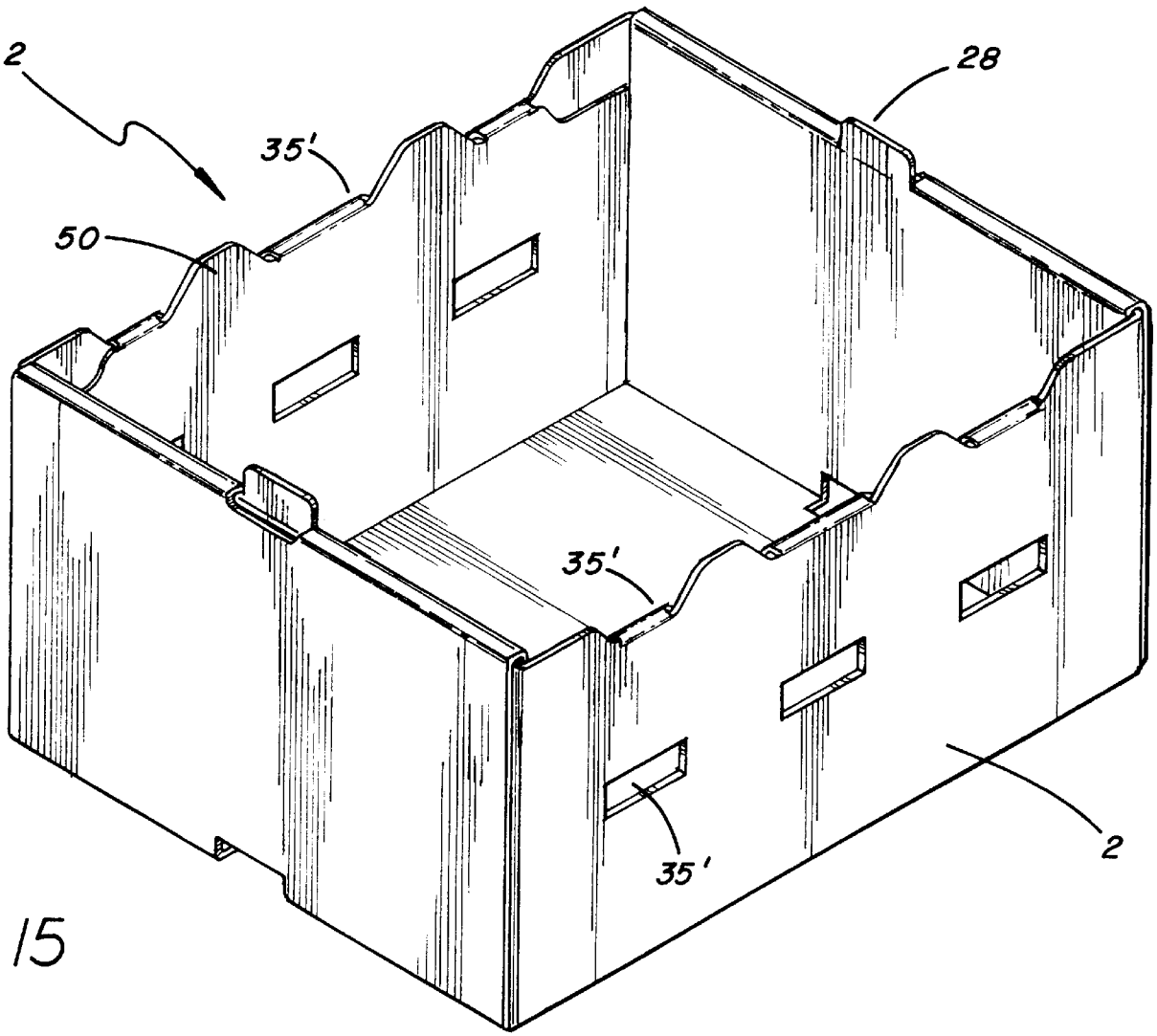
FIG. 15 is a perspective view of a third alternative tray incorporating flow restriction tabs, the tray further optimized for producing turbulent flow, and for receiving therein a plurality of layers of baskets.
Figure 16:
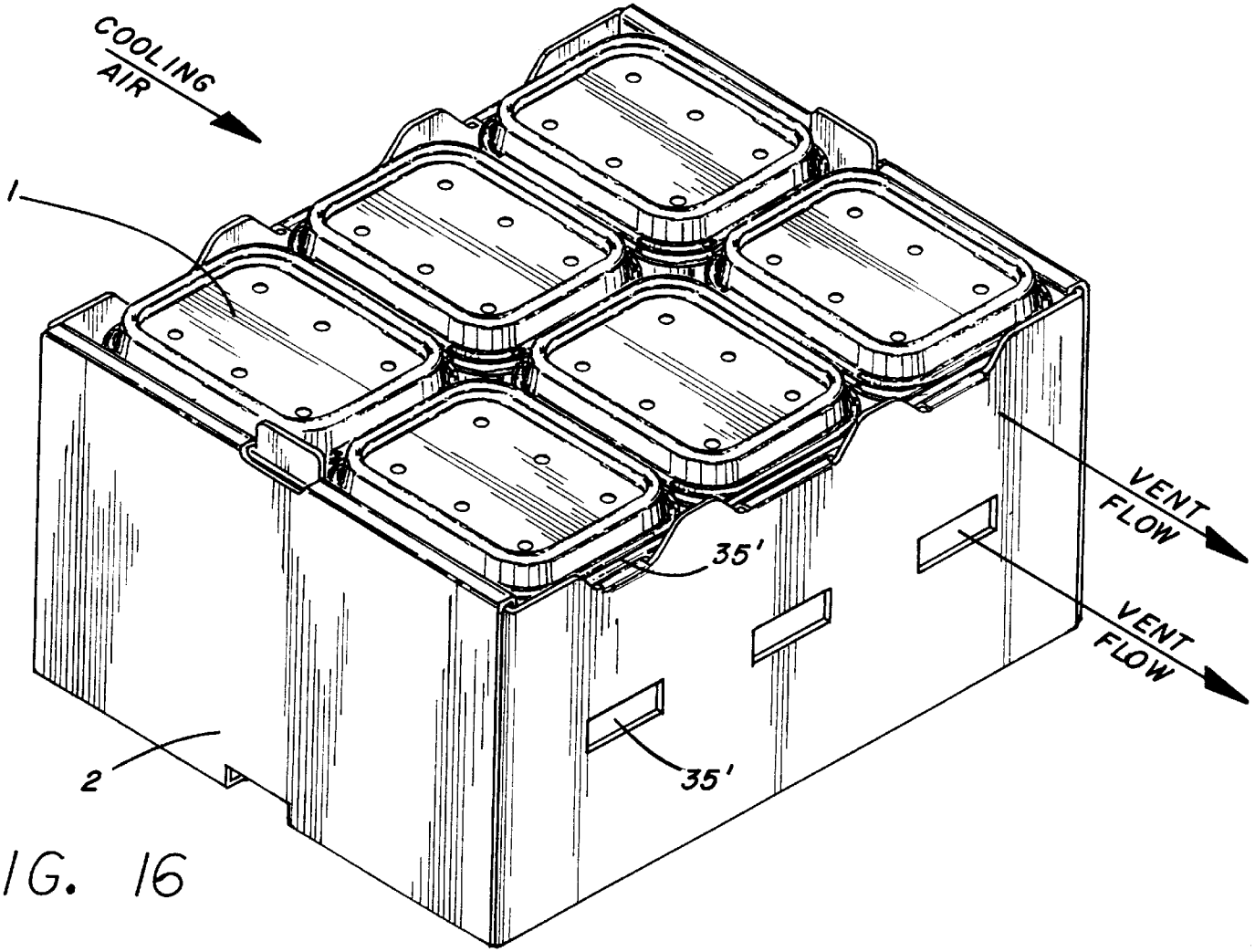
FIG. 16 is a perspective view of a plurality of closed produce baskets loaded into the third alternative tray formed to receive therein a plurality of layers of baskets, the tray being optimized for producing turbulent flow.
Figure 17:
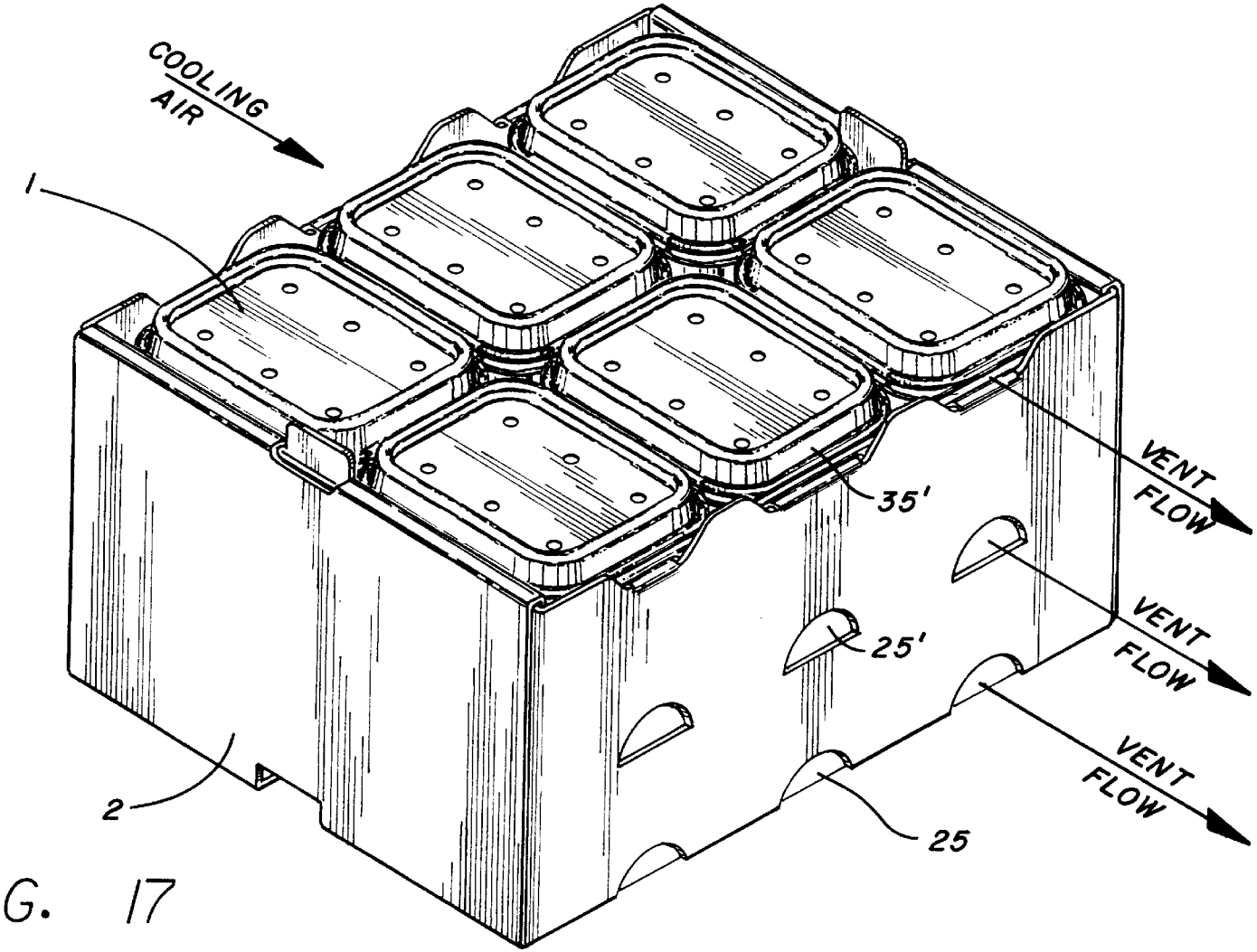
FIG. 17 is a perspective view of a plurality of closed produce baskets loaded into a fourth alternative tray formed to receive therein a plurality of layers of baskets, the tray for providing relatively laminar air flow.
Figure 18:
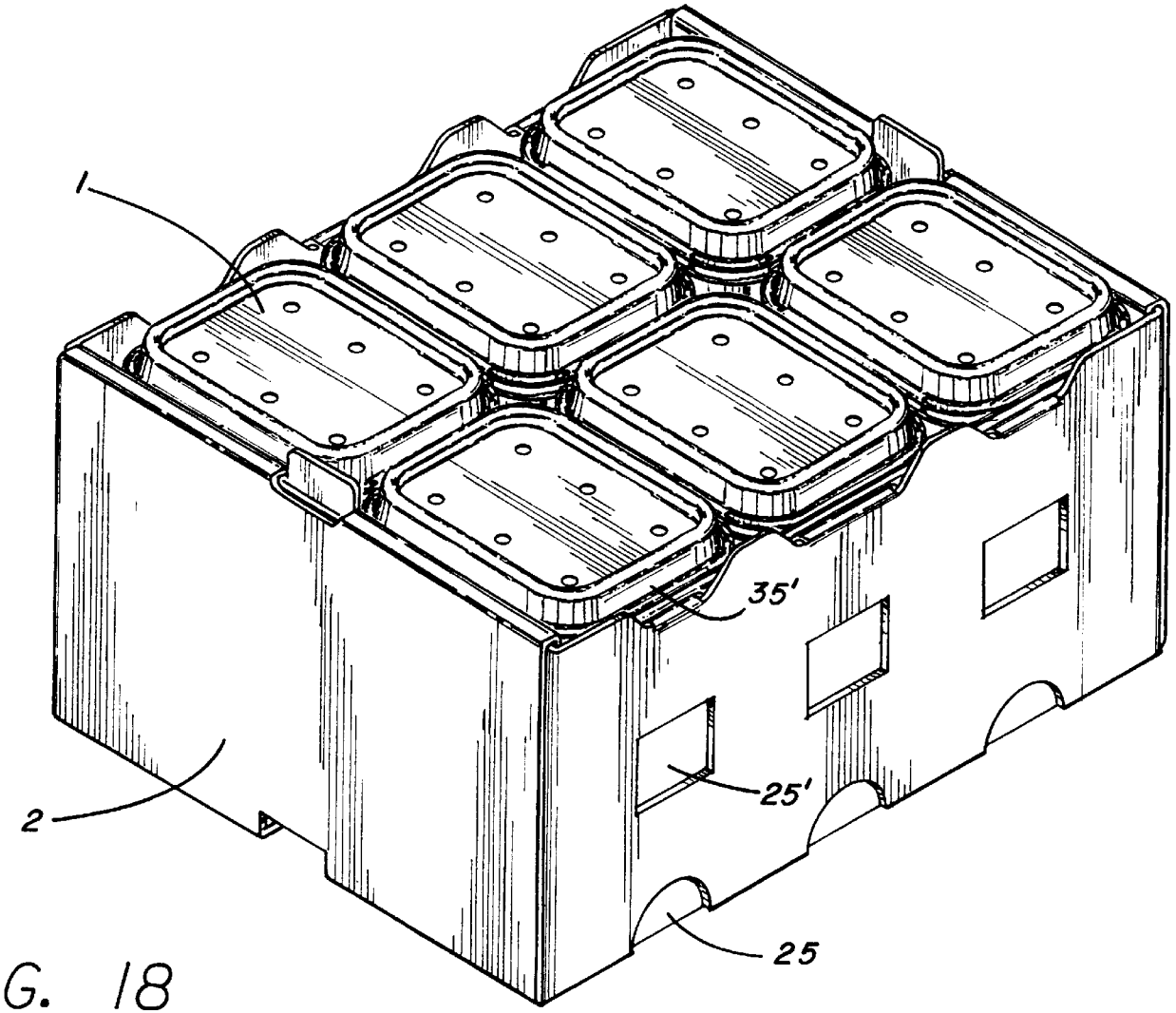
FIG. 18 is a perspective view of a plurality of closed produce baskets loaded into a fifth alternative tray formed to receive therein a plurality of layers of baskets, the tray for providing relatively laminar flow of cooling air.

Moreover, tray 2 may be formed to receive therein a plurality of layers of filled baskets 1. Examples of such embodiments are shown in FIGS. 15–18 Having reference now to FIGS. 17 and 18, one embodiment of the present invention designed to hold two layers of the filled baskets is shown. In this embodiment, the first described cooling air regime is selected, and both tray vents 25 and horizontal cutaway sections 35' are employed. Moreover, at least one pair of modified tray vents, 25' is formed on opposite sides of tray 2 to perform the functions of tray vent 25 for the upper layer of baskets 1, and cutaway sections 35' for the lower layer of baskets 1. Modified tray vents 25' may be formed with a number of geometries. Two such are shown in FIGS. 17 and 18.

With continued reference to FIG. 4, tray 2 in a first preferred embodiment is formed of cut and folded corrugated cardboard formed in a manner well known to those of skill in the art. One such corrugated cardboard is Georgia-Pacific USP120-33sml-USP120, although any number of packaging materials well known to those of ordinary skill in the art could, with equal facility, be used. Such alternative materials include, but are not limited to various cardboards, pressboards, flakeboards, fiberboards, plastics, metals and metal foils. In some embodiments of tray 2, it may further be advantageous to incorporate a gluing, adhesive or fastening step in fabrication of the tray, again in accordance with generally accepted practices in container design and fabrication.

Because of the smaller size of the trays of the present invention, a lighter grade of corrugated board is may be used for their manufacture than are trays required to support the greater weight and greater area of the Michigan baskets previously described. This lighter weight not only minimizes shipping costs, but can significantly reduce packaging costs for the shipper, again lowering consumer costs. While the tray of a first preferred embodiment is formed of corrugated cardboard, the principles of the present invention may with equal facility be implemented on a variety of alternative tray materials. Such alternative materials include, but are not limited to various polymeric and monomeric plastics again including but not limited to styrenes, polyethylenes including HDPE and LPDE, polyesters and polyurethanes; metals and foils thereof; paper products including chipboard, pressboard, and flakeboard; wood; wire; and combinations of the foregoing.

Figure 13:
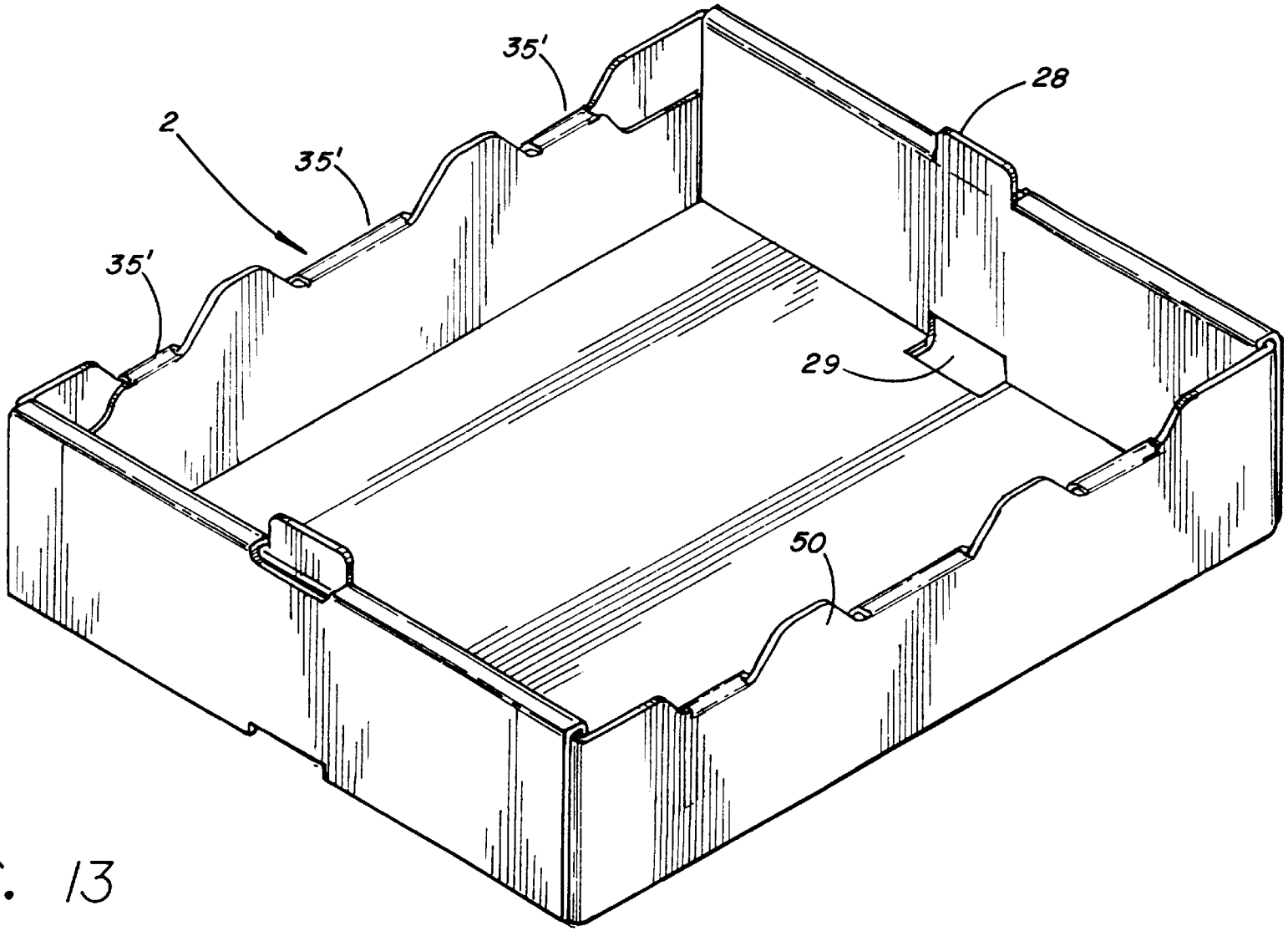
FIG. 13 is a perspective view of a second alternative tray incorporating flow restriction tabs, and optimized for producing turbulent flow.
Figure 14:
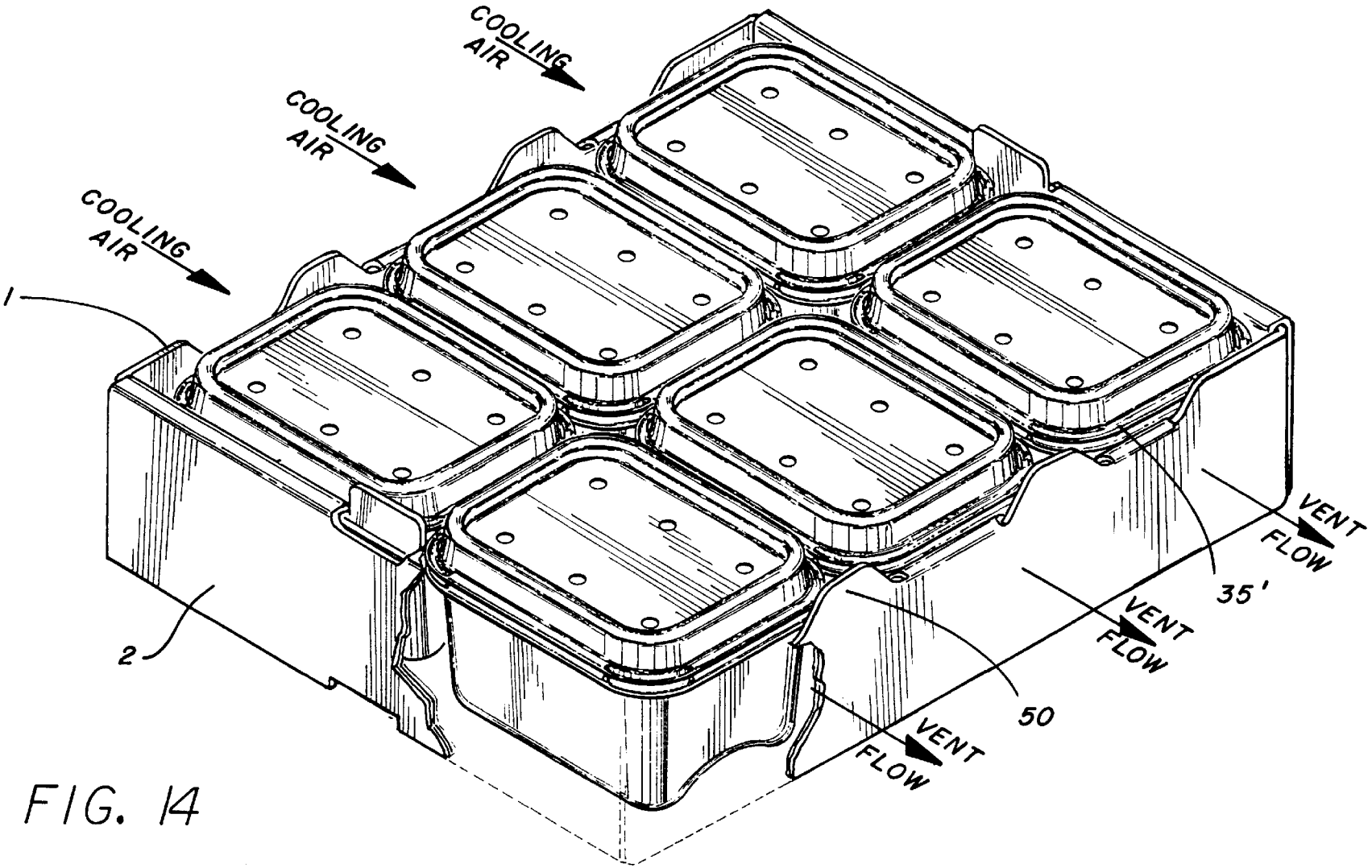
FIG. 14 is a perspective view of a plurality of closed produce baskets loaded into the second alternative tray.

A second preferred embodiment of the present invention, implementing an alternative cooling air regime, can be provided by altering the ventilation provided by tray 2. In this general class of embodiments, shown in FIGS. 13–16, tray vents 25 or 25' of the previously discussed embodiments are eliminated, and substantially all cooling air is directed to horizontal slots 5 of baskets 1 through cutaway sections 35 or 35' of tray 2. An example of such a tray, formed to receive therein a single layer of baskets 1, is shown in FIGS. 13 and 14. Another such tray, formed to receive therein a plurality of layers of baskets 1 is shown in FIGS. 15 and 16. Each of trays 2 shown in FIGS. 13–16 are shown as employing divider tabs 50. In studying the principles of the present invention, those having ordinary skill in the art will note that this second cooling air regime may, with equal facility, be implemented without recourse to divider tabs 50.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the use of alternative basket forming technologies, tray forming technologies, basket and tray materials and specifications, basket shapes and sizes to conform to differing produce requirements, and vent configurations are all contemplated by the principles of the present invention. The inventions illustratively disclosed herein may be practiced without any element which is not specifically disclosed herein.

We claim:

1. A produce container comprising in operative combination:

basket means including basket body means and lid means;

latch means for reversibly securing said lid means to said body means;

ventilation channel means formed in a lower surface of said basket body means;

lower vent means further disposed on said lower surface of said basket body means in communication with said ventilation channel means; and upper vent means.

2. The produce container of claim 1 wherein said upper vent means is disposed on a substantially upper surface of said lid means.

3. The produce container of claim 2 wherein said body means and said lid means further define a horizontal ventilation slot.

4. The produce container of claim 3 wherein said horizontal ventilation slot extends more than one-half the vertical extent of said lid means.

5. The produce container of claim 1 wherein said latch means further comprises a pair of toothed mating latches including a first engageable tooth disposed upon said basket body means and a second engageable tooth disposed upon said lid means.

6. The produce container of claim 5 wherein said latch means further comprises a plurality of pairs of toothed mating latches.

7. The produce container of claim 1 wherein said produce container is a one-piece structure, said structure defining both said basket body means and said lid means.

8. The produce container of claim 7 further defining hinge means joining said basket body means and said lid means.

9. The produce container of claim 8 wherein said hinge means comprises a flexible hinge.

10. The produce container of claim 1 wherein said basket means further comprises:

said basket body means; and said lid means further comprising a separate lid structure, reversibly securable to said basket body means by said latch means.

11. A produce container comprising:

a basket;

a lid for covering the basket;

at least one latch for reversibly securing the lid to the basket;

at least one upper ventilation aperture formed in at least one of the basket and the lid;

at least one lower ventilation aperture formed in the basket; and a ventilation slot formed between the basket and the lid.

12. A produce container comprising:

a basket, including a basket body and a lid;

a latch for reversibly securing the lid to the basket body, and for maintaining the lid in a secured position with respect to the basket body;

the basket body and the lid defining, when the lid is secured with to the basket body, a ventilation slot;

a ventilation channel formed in a lower surface of the basket body; and the basket body defining at least one lower ventilation aperture at the lower surface of the basket body and in communication with the ventilation channel.

13. The produce container of claim 12 further defining at least one upper ventilation aperture.

14. The produce container of claim 13 wherein the upper ventilation aperture is formed in the lid.

15. The produce container of claim 13 wherein the upper ventilation aperture is formed in the basket body.

16. The produce container of claim 12 wherein the basket body further comprises:

a bottom;

first and second ends; and first and second sides.

17. The produce container of claim 15 wherein the bottom, first and second ends, and first and second sides define a unitary whole basket body.

18. The produce container of claim 15 wherein at least one of the bottom, the first and second ends, and the first and second sides is a substantially smooth structure, free of reinforcing ribs.

19. The produce container of claim 18 wherein the bottom, the first and second ends, and the first and second sides are substantially smooth structures, free of reinforcing ribs.

20. A produce container comprising:

a one-piece basket, the basked defining both a basket body and an integral lid joined by a flexible hinge, the basket body including a bottom, first and second ends, and first and second sides, the bottom, the first and second ends, and the first and second sides forming a substantial whole article defining the basket body, and at least one of the bottom, the first and second ends, and the first and second sides being a substantially smooth structure, free of reinforcing ribs;

three sets of paired, mating detent latches, each of the sets of latches including a first engageable tooth disposed upon the basket body and a second engageable tooth disposed upon the lid, the latches for reversibly securing the lid to the basket body and for maintaining the lid in the secured position with respect to the body by the elastic deformation of at least one of the first and second teeth;

a horizontal ventilation slot formed by the edges of the basket body and the lid when the lid is positioned in the secured position with respect to the basket body;

a lateral ventilation channel formed in a lower surface of the basket body; and the basket body defining at least one lower ventilation aperture in communication with the lateral ventilation channel and at least one upper vent in at least one of an upper portion of the basket and the lid.

* * * * *